United States Patent [19]

Abboud

[11] 3,998,208

[45] Dec. 21, 1976

[54] LIQUID HEATER DEVICE

[75] Inventor: Harry I. Abboud, Baton Rouge, La.

[73] Assignee: Kaiser Aluminum & Chemical Corporation, Oakland, Calif.

[22] Filed: June 16, 1975

[21] Appl. No.: 587,494

[52] U.S. Cl. ..... 126/377; 126/383; 159/16 S; 261/114 R; 122/31 R

[51] Int. Cl.[2] ..... F24H 1/10

[58] Field of Search ..... 122/31; 261/112, 113, 261/114; 159/15, 16 S, 18; 126/377, 379, 381, 382, 383

[56] References Cited

UNITED STATES PATENTS

| | | | |
|---|---|---|---|
| 514,814 | 2/1894 | Cooper | 261/114 R |
| 654,093 | 7/1900 | Emerick | 159/15 |
| 1,236,097 | 8/1917 | Monroe | 159/18 |
| 2,426,096 | 8/1947 | Heineman | 159/18 |
| 2,616,670 | 11/1952 | Van Der Molen | 261/114 R |
| 2,692,129 | 10/1954 | Wilson et al. | 261/114 R |
| 3,064,408 | 11/1962 | Erga et al. | 261/114 R |

*Primary Examiner*—John J. Camby
*Assistant Examiner*—Larry I. Schwartz
*Attorney, Agent, or Firm*—Paul E. Calrow; Andrew E. Barlay

[57] ABSTRACT

A device is provided for heating liquids, slurries and the like by direct condensation of steam. The device consists of a vertically oriented, substantially cylindrical elongated vessel, wherein liquid to be heated is introduced at the top and the heated liquid is removed at the bottom. The device is provided with at least one liquid treatment zone consisting of a perforated tray placed perpendicular to the downward flow of the liquid, a downwardly conveying cone-shaped underflow located below the tray and a hemispherical impingement surface positioned below the opening of the cone-shaped underflow. Steam is introduced in the zone at a point where the liquid exits from the underflow. This arrangement allows a maximum degree of heat exchange between the steam and the liquid without causing "hammering" due to excessive steam condensation.

4 Claims, 3 Drawing Figures

LIQUID HEATER DEVICE

BACKGROUND OF THE INVENTION

Heating of liquids, slurries and the like by direct injection of steam has been employed for many decades. A common problem associated with the direct condensation of steam into liquids is the so-called "hammer" caused by the rapid collapse or condensation of the steam. This "hammer" effect is generally aggravated by the substantial temperature difference between the liquid to be heated and the steam. Hammering results in vibrations which can cause serious damage to the heating vessel and to the associated equipment. In addition to the above-referred to hammering, direct injection of steam in many instances does not provide optimum heat transfer between the steam and the liquid to be heated and consequently, the heat balance will be unfavorable.

The present invention is directed to an apparatus which substantially overcomes the problems associated with heating of liquids, slurries and the like.

SUMMARY OF THE INVENTION

The present invention concerns a device for heating liquids, slurries and the like by direct condensation of steam onto liquid surfaces. The device consists of an elongated, closed vessel having a substantially cylindrical cross-sectional configuration, the longer axis of the vessel being arranged in a substantially vertical plane. The vessel is provided with a liquid inlet at its top portion and a conical bottom portion for the discharge of liquid. In the interior of the vessel a plurality of spaced liquid treatment zones is provided, at least one zone comprising a circular tray located perpendicular to the longer axis of the vessel, a cone-shaped, downwardly narrowing underflow associated with the tray to provide a convergent flow for liquid streaming downwardly in the vessel from the tray and a hemispherical impingement surface located below the mouth of the overflow to provide a divergent flow for liquid exiting through the mouth of the underflow. Associated with each zone a steam introduction means is provided at or below about a point where the liquid exits from the mouth of the underflow. This arrangement allows maximum heat-transfer between the steam and the liquid without causing hammering of the walls of the vessel and equipment associated with the vessel.

DETAILED DESCRIPTION OF THE INVENTION

Figure 1:
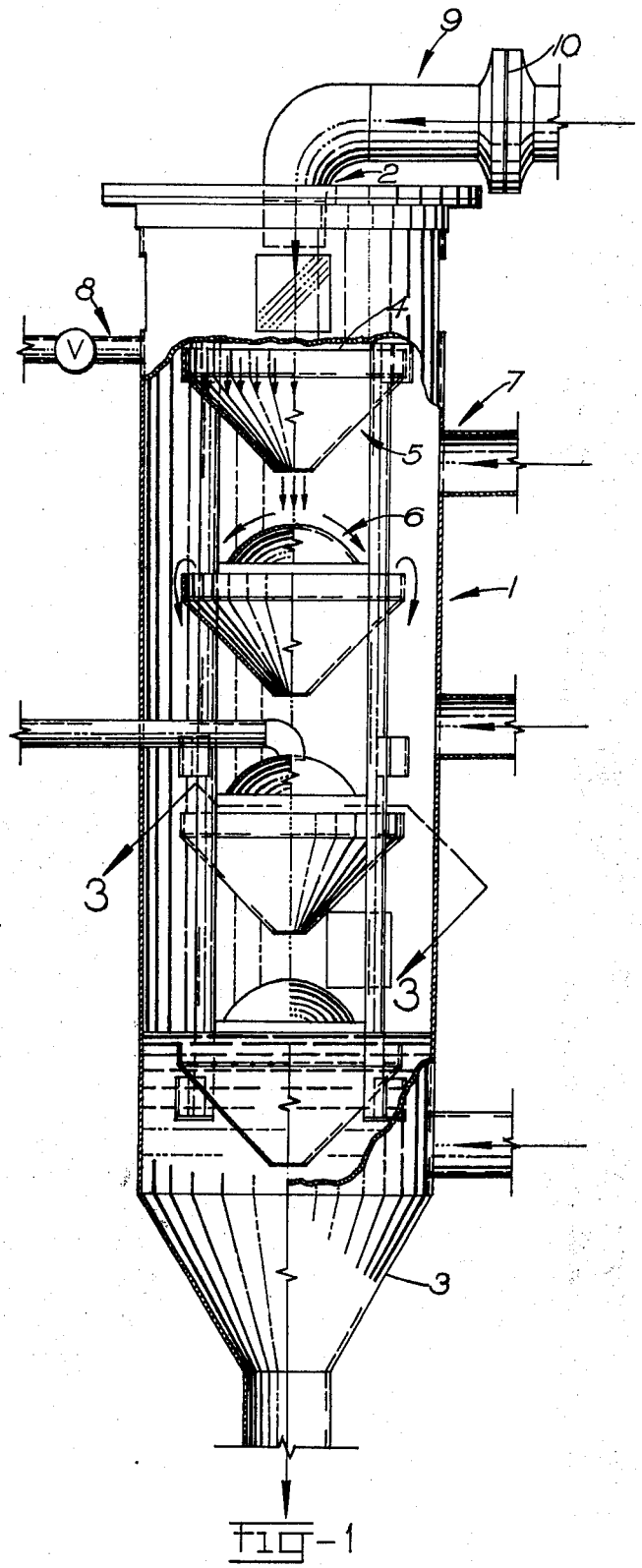
FIG. 1 is a schematic side view of the vessel having a plurality of liquid treatment zones including steam introduction means.

The present invention relates to a device for heating liquids, slurries and the like by direct condensation of steam. The device as shown in FIG. 1 consists of a substantially cylindrical vessel 1 having its longer axis in the vertical plane. The vessel is provided with a liquid inlet 2 at its top portion and a conical bottom portion 3 for the discharge of liquid. Liquid is fed to the heating vessel through inlet 2 and the liquid during its downward flow contacts tray 4, which forms part of the novel liquid treatment zone of the instant device.

The tray has a generally circular shape and the center point of the circular tray substantially coincides with the longer axis of the vessel. The diameter of the tray is chosen in such a manner as to provide a space between the inner wall of the vessel and the edge portion of the tray. In one embodiment of the invention, tray consists of a perforated plate-like structure which allows distribution of the liquid impinging thereon into a plurality of streams.

Figure 2:
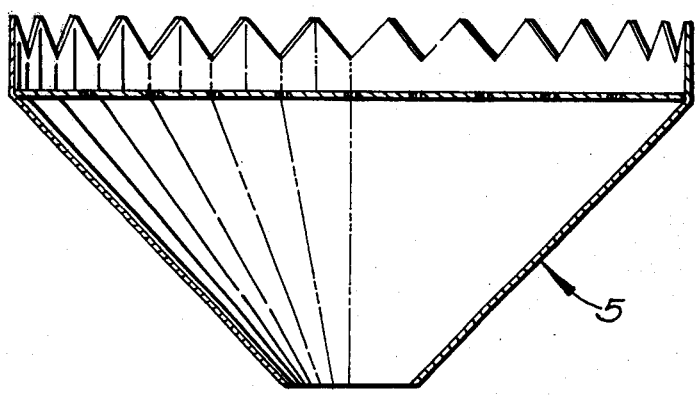
FIG. 2 shows a side view of a tray having a notched weir-like overflow.
Figure 3:
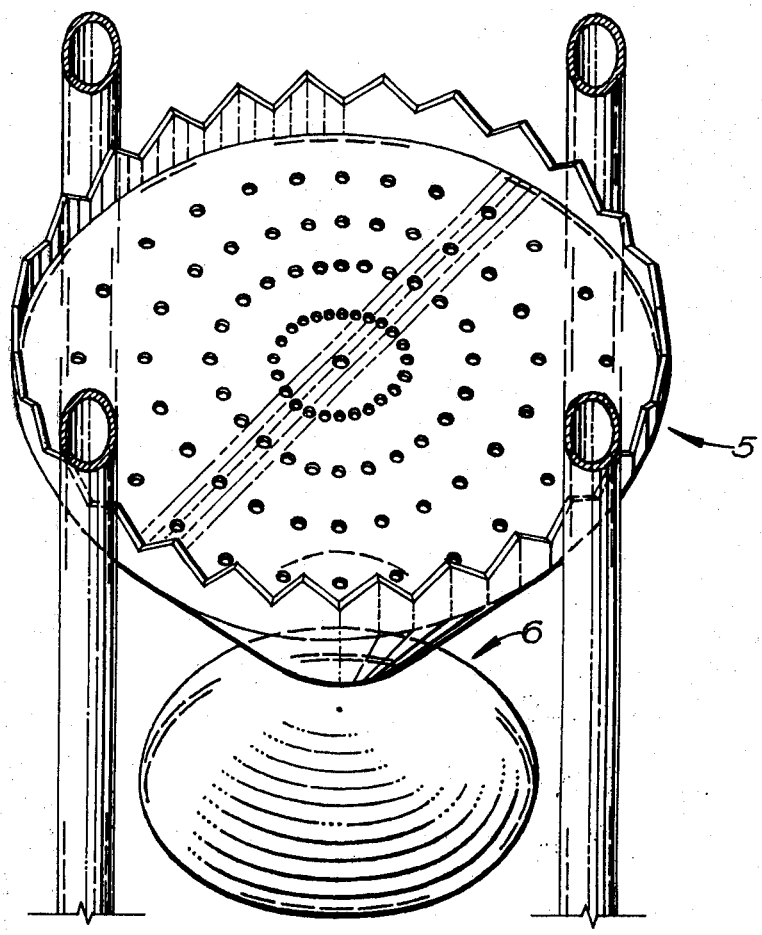
FIG. 3 is a perspective view of a liquid treatment zone comprising a tray, an underflow and a hemispherical impingement surface.

The tray may also possess a notched, weir-like edge portion, such as shown in FIG. 2 of the drawing. The notched, weir-like edge portion allows a substantially uniform overflow of the liquid from the tray. If desired, the tray employed in the instant device may be a perforated tray having a notched, weir-like edge, a solid tray having no perforations at all, but having a notched, weir-like edge portion; or a perforated tray having a smooth edge. For optimum results, a tray having a notched, weir-like edge portion with or without perforations in the tray, is utilized.

Within the liquid treatment zone associated with the tray, a funnel or cone-shaped underflow 5 is provided. This underflow serves to impart the liquid leaving the tray a substantial convergent downward flow. Below the mouth of underflow 5, a hemispherical impingement surface 6 is provided. The center of this hemispherical impingement surface coincides substantially with the longer axis of the vessel and it is positioned below the mouth of the underflow in a manner so as to provide a divergent flow for the liquid exiting from the underflow. The liquid treatment zone is further provided with steam injection means 7. The steam introduction means is suitably so positioned, as shown in FIG. 1 of the drawing, that it discharges steam at high velocity into the area where the liquid exits from the cone-shaped underflow. The high velocity steam will contact the liquid within the area where the liquid begins a divergent flow and thus provides optimum heat transfer between the steam and the downwardly flowing liquid. The steam introduction means utilized in the instant device can be of any known design generally employed for such purpose. The steam introduction means, such as jets, can be positioned in any desired manner, for example to provide either a tangential or a perpendicular impingement with the liquid to be heated. Due to the arrangement of the liquid treatment zone within the vessel it is assured that condensation of a major portion of steam takes place only after contact with the liquid.

The number of liquid heating zones to be utilized in the device of the instant invention depends on the temperature of the incoming liquid and the final temperature desired upon exit from the vessel. It is also dependent on the flow rate of the liquid as well as the dimensions of the heating vessel and the temperature and pressure of the steam. It has been found that, for example, when a vessel of approximately 4.9 meters height (approximately 16 feet) and approximately 1.2 meters diameter (approximately 4 feet) is employed and the rate of liquid flow is approximately 7570 l/min. (approximately 2000 gallons/min), the incoming liquid temperature is about 62° C (145° F) and the desired final temperature is 100° C (212° F), three liquid treating zones provide the desired result when steam of 120° C temperature is introduced at a rate of about 36,200–45,300 kg/hour (80,000–100,000 lbs/hour).

The device, as is customary for vessels operating by steam, is equipped with vent 8 to release any excess steam, if desired. In addition, at the top of the vessel, for convenience sake an overflow 9, having a rupture disc 10 is provided.

The device of the instant invention operates at barometric pressure although slight pressure over the atmospheric can also be utilized. Due to the downward flow of the liquid and the discharge of the heated liquid under some circumstances there could also be a slight vacuum generated in the system.

The utility of the instant device extends to the heating of water, aqueous solutions, slurries and the like. It finds particular importance in the heating of slurries, such as bauxite particles suspended in an aqueous caustic solution. When the instant device is utilized for the heating of bauxite slurries, for example, to a temperature required for the extraction of alumina from bauxite, the novel liquid treatment zone concept allows maintenance-free, non-scaling operation of the vessel without causing hammering due to excessive steam condensation on the walls of the vessel.

What is claimed is:

1. A device for heating liquids, slurries and the like by the condensation of steam on liquid surfaces comprising the combination of an elongated vessel for heating said liquids, the vessel including a substantially cylindrical housing means, said housing means being provided at its lower end with a cone-shaped bottom member, the top portion of the cylindrical housing means being provided with a liquid inlet means and the bottom portion thereof being provided with a liquid discharge means, the cylindrical housing having a plurality of spaced liquid treatment zones arranged within the interior thereof, at least one of said zones having a circular, substantially horizontal tray disposed therein in such a fashion so that its center point substantially coincides with the vertical axis of said cylindrical housing means while its diameter is smaller than the inner diameter of the cylindrical housing means to provide an annular space through which the liquid can flow downwardly from a liquid treatment zone, a cone-shaped underflow means located below the tray, said cone-shaped underflow means having a bottom opening and downwardly and inwardly converging side walls to provide the liquid downwardly flowing from the tray with a convergent flow; and a hemispherically shaped impingement means located below the bottom opening of the cone-shaped underflow means to effect a subsequent, divergent flow of liquid exiting from the bottom opening of said underflow means and said zone also including means for introducing steam into the housing means at a point below the bottom opening of said underflow means.

2. Device of claim 1, wherein the tray is a perforated tray.

3. Device of claim 1, wherein the tray has at its periphery a notched, weir-like overflow.

4. Device of claim 1, wherein the cone-shaped underflow is a downward extension of the tray.

* * * * *